US008752711B2

(12) United States Patent
Campbell

(10) Patent No.: US 8,752,711 B2
(45) Date of Patent: Jun. 17, 2014

(54) SYSTEM AND METHOD OF SORTING ELONGATED WOOD BOARDS FOR PREPARING ROWS

(76) Inventor: Léo Campbell, Sainte-Agathe-de-Lotbiniére (CA)

( * ) Notice: Subject to any disclaimer, the term of this patent is extended or adjusted under 35 U.S.C. 154(b) by 208 days.

(21) Appl. No.: 12/105,829

(22) Filed: Apr. 18, 2008

(65) Prior Publication Data

US 2008/0257786 A1 Oct. 23, 2008

Related U.S. Application Data

(60) Provisional application No. 60/907,837, filed on Apr. 19, 2007.

(51) Int. Cl.
*B07C 5/14* (2006.01)

(52) U.S. Cl.
USPC ..... 209/517; 209/518; 209/521; 209/586; 209/657; 209/658

(58) Field of Classification Search
USPC ..... 209/517, 518, 521, 586, 657, 658, 923, 209/933
See application file for complete search history.

(56) References Cited

U.S. PATENT DOCUMENTS

| | | | | |
|---|---|---|---|---|
| 2,600,147 | A | 6/1952 | Wilson | |
| 2,662,640 | A | 12/1953 | Dedo | |
| 2,762,508 | A | 9/1956 | Parton | |
| 2,800,225 | A | 7/1957 | McColl et al. | |
| 2,821,301 | A | 1/1958 | Montague | |
| 2,998,133 | A * | 8/1961 | Rambo | 209/521 |
| 3,006,468 | A | 10/1961 | Blake | |
| 3,080,969 | A | 3/1963 | Blake | |
| 3,116,835 | A * | 1/1964 | Brandon | 209/520 |
| 3,203,559 | A | 8/1965 | Macy | |
| 3,247,963 | A * | 4/1966 | Fehely | 209/520 |
| 3,279,600 | A | 10/1966 | Lawson | |
| 3,292,783 | A | 12/1966 | Quist et al. | |
| 3,343,689 | A | 9/1967 | Fehely | |
| 3,522,880 | A | 8/1970 | Mellott et al. | |
| 3,631,977 | A | 1/1972 | Taul | |
| 3,687,178 | A * | 8/1972 | Golick et al. | 83/107 |
| 3,700,120 | A * | 10/1972 | Romick et al. | 414/564 |
| 3,889,825 | A | 6/1975 | Mosely | |
| 4,195,737 | A * | 4/1980 | Rysti | 209/521 |
| 4,205,751 | A | 6/1980 | Rysti | |
| 4,384,814 | A | 5/1983 | Moseley | |
| 4,892,458 | A | 1/1990 | Proulx | |
| 4,992,949 | A * | 2/1991 | Arden | 700/223 |
| 5,544,757 | A * | 8/1996 | Geiger et al. | 209/518 |
| 5,613,827 | A * | 3/1997 | Vande Linde | 414/791.6 |

(Continued)

*Primary Examiner* — Stefanos Karmis
*Assistant Examiner* — Michael E Butler
(74) *Attorney, Agent, or Firm* — Benoît & Côté Inc.

(57) ABSTRACT

This invention concerns a system for sorting elongated random width wood boards and preparing board rows having a row width within a predetermined width range. The system comprises a main longitudinal surface, a conveyor for conveying the boards on the main surface, a width detector, and accumulating compartments located one after the other under the main surface, controllable traps located on the main surface providing access to the accumulating compartments, controllable gates for retaining or releasing the boards accumulated therein and a controller. The controller selectively distributes each of the boards into the accumulating compartments, and controls the gates of the accumulating compartments to release the boards accumulated therein when the sum of the widths of the boards accumulated is within the predetermined width range.

14 Claims, 9 Drawing Sheets

(56) References Cited

U.S. PATENT DOCUMENTS

| | | | | |
|---|---|---|---|---|
| 5,964,570 | A | 10/1999 | Dimion et al. | |
| 6,016,922 | A * | 1/2000 | Burman | 209/621 |
| 6,031,567 | A * | 2/2000 | Johnson | 348/91 |
| 6,112,903 | A * | 9/2000 | Kimmel et al. | 209/11 |
| 6,220,423 | B1 | 4/2001 | Gagnon et al. | |
| 6,510,364 | B2 | 1/2003 | Ahrens | |
| 6,598,747 | B1 | 7/2003 | Ahrens | |
| 6,655,902 | B2 | 12/2003 | Dubé et al. | |
| 6,722,844 | B2 * | 4/2004 | Lunden | 414/789.5 |
| 7,201,554 | B2 | 4/2007 | Hogue et al. | |
| 7,571,818 | B2 * | 8/2009 | Quick | 209/518 |
| 7,974,731 | B2 * | 7/2011 | Sander | 700/167 |
| 8,061,526 | B2 * | 11/2011 | Henderson | 209/518 |
| 8,083,060 | B1 * | 12/2011 | Liu | 206/379 |
| 8,167,136 | B2 * | 5/2012 | Betti | 209/620 |
| 2002/0159876 | A1 * | 10/2002 | Ahrens | 414/790.1 |
| 2003/0034224 | A1 * | 2/2003 | Bernard et al. | 198/418 |
| 2003/0091421 | A1 | 5/2003 | Piche et al. | |
| 2005/0132667 | A1 * | 6/2005 | McLeod et al. | 53/390 |
| 2010/0116721 | A1 * | 5/2010 | Henderson | 209/517 |
| 2013/0233774 | A1 * | 9/2013 | Maki-Haapoja | 209/517 |

* cited by examiner

SYSTEM AND METHOD OF SORTING ELONGATED WOOD BOARDS FOR PREPARING ROWS

CROSS REFERENCE TO RELATED APPLICATIONS

This application claims priority of U.S. Provisional Patent Application No. 60/907,837, filed on Apr. 19, 2007, the entirety of which is incorporated herein by reference.

FIELD OF THE INVENTION

This invention generally relates to lumber sorting and more particularly concerns a method and an automated system of sorting elongated wood boards, such as hardwood and pine wood boards, for preparing rows within a predetermined maximum width.

BACKGROUND OF THE INVENTION

In the hardwood and pine wood industry, planning mills and sawmills generally produce lumbers in the form of elongated boards which are stacked in rows for drying and/or shipping purposes. Generally, these board rows are stacked according to their length, thickness or grade.

When a stack of wood boards is prepared, each layer or row of the stack must have or be close to a predetermined maximum width. Wood boards in a stack may have different dimensions of width and therefore an operator is required to prepare each row or layer of the stack. More particularly, the operator places several wood boards side by side to form a row having a maximum width. If the row of selected wood boards is not close to the maximum width, the operator can substitute one or several wood boards with other boards until the row substantially reaches the maximum allowed width without exceeding it. Alternatively, the operator can simply remove one of the wood boards to form a row having a reduced width. Once the row is completed, it can be stacked on other rows to form a stack. In either case, the productivity decreases: in the first case, the decrease is due to the time lost in handling the pieces of wood while, in the second case, it is due to the fact that the stack contains less wood than possible.

A common practice in this industry is to place rows of longer wood boards underneath the stacks and to place longer boards on both sides of the stacks. Placing the wood boards as such allows the forks of stackers to slide more easily underneath the board rows when handling them and avoid smaller boards to be dropped during the stacker handling. Stacks formed as such are also more solid, the smaller boards being contained within the 'shell' formed by longer boards located on the outside of the stack, reducing the chances for the stacks to slump down during transport. This operation of selecting boards for forming rows according to their length after having selected them according to their widths is tedious and is even more time consuming.

Already known in the art are systems for selecting random length wood boards for forming lines of several boards placed end to end having a predetermined length. Also known in the art are systems for sorting and stacking wood boards according to their length for forming groups of boards, each formed by boards of similar length.

The following documents disclose different sorting systems of wood boards: U.S. Pat. Nos. 2,600,147; 2,662,640; 2,762,508; 2,800,225; 2,821,301; 3,006,468; 3,080,969: 3,116,835; 3,203,559; 3,279,600; 3,292,783; 3,343,689; 3,522,880; 3,631,977; 3,889,825; 4,205,751; 4,384,814; 4,892,458; 5,613,827; 5,964,570; 6,016,922; 6,220,423; 6,510,364; 6,598,747; 6,655,902; 7,201,554 and US 200310091421.

None of these systems show how to sort wood boards according to their width for forming rows of boards within a predetermined width range. Neither do they show how to form board rows of constant width further having constant length or longer boards on their sides.

In addition, boards to be stacked in stacks of predetermined width rows are often pre-sorted according to their thickness or grade using different sorting systems. It would be more efficient if this sorting could be made at the same time as the width or length sorting of the boards when forming rows having a predetermined width.

Therefore, there is a need to automate the preparation of rows having a width within a predetermined range in order to increase the productivity and reduce the manual labor costs.

It would also be desirable to further automate the preparation of rows having a width with a predetermined range so that longer boards are placed on each side of a row and so that they form the bottom rows of board stacks.

It would also be desirable to be able to sort boards according to their thickness or grade when forming rows having a predetermined width range.

SUMMARY OF THE INVENTION

An object of the present invention is to provide a system for sorting elongated wood boards that satisfies at least one of the above needs.

According to the present invention, there is provided a system for sorting elongated random width wood boards and preparing board rows having a row width within a predetermined width range. The system comprises a main longitudinal surface for supporting the boards. The main surface has an entry and an exit. A conveyor conveys the boards transversally on the main surface from the entry to the exit. A width detector detects each of the boards that is conveyed on the main surface and generates a width detecting signal for each of the boards. Accumulating compartments are located one after the other under the main surface and they each have an entrance and an exit. Controllable traps are located on the main surface, and are associated respectively with the accumulating compartments. Each of the traps is movable between an opened position which provides access to the entrance of the corresponding accumulating compartment and a closed position which allows the boards to be supported. Controllable gates selectively blocks and unblocks the exits of the accumulating compartments and thereby boards accumulated in any of the accumulating compartments can be selectively retained in the compartments and released from it. A controller is operatively connected to the width detector, the traps and the gates. The controller has an input to receive the width detecting signal for each of the boards from the width detector and has outputs to send control signals to the controllable traps in response to the width detecting signal. It can therefore selectively distribute each of the boards into the accumulating compartments. The controller can also send other control signals to the controllable gates of the accumulating compartments to release the boards accumulated in it when a sum of the widths of the boards accumulated is within the predetermined width range. Sliding means are provided for sliding off boards from the accumulating compartments in board rows when they are released by the gates.

According to the present invention, there is also provided a method for sorting elongated random width wood boards and preparing board rows having a row width within a predetermined width range. The method comprises the steps of:

detecting boards that are conveyed on a main longitudinal surface using a width detector and generating a width detecting signal for each of said boards;

receiving the width detecting signal for each of the boards in an input of a controller and sending control signals from an output of the controller to controllable traps located on the main surface and providing access to accumulating compartments, in response to the width detecting signal to selectively distribute each of the boards into corresponding accumulating compartments;

sending other control signals to controllable gates blocking the exit of the accumulating compartments for unblocking the exit and releasing the boards accumulated therein when a sum of the widths of the boards accumulated is within the predetermined width range; and sliding off completed rows of boards out the accumulating compartments.

Figures 1A, 1B:
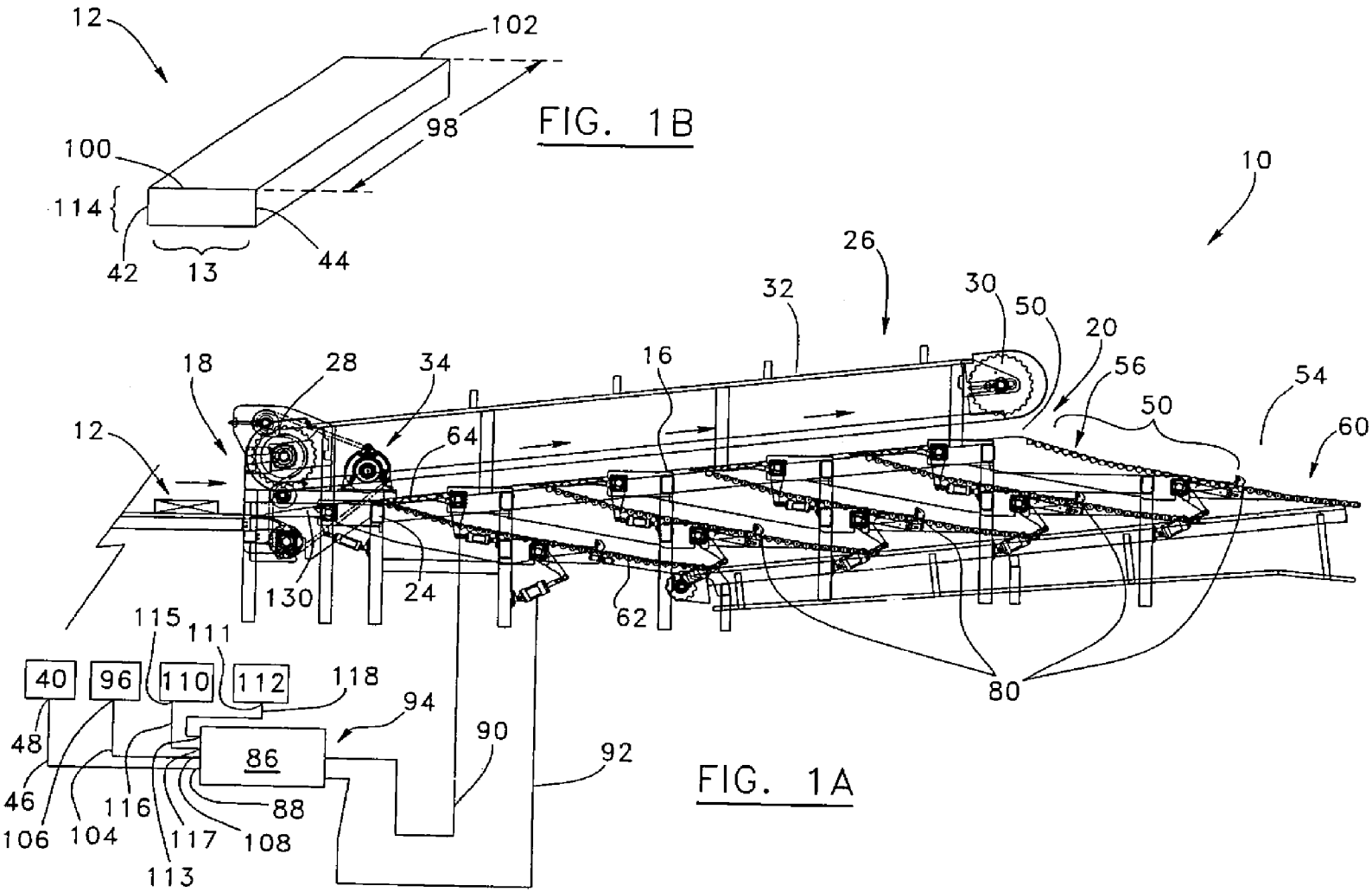
FIG. 1A is a side view of a sorting system according to a preferred embodiment s of the present invention.
FIG. 1B is a perspective view of a wood board.

While the invention will be described in conjunction with example embodiments, it will be understood that it is not intended to limit the scope of the invention to such embodiment. On the contrary, it is intended to cover all alternatives, modifications and equivalents as may be included as defined by the present description and appended claims.

DESCRIPTION OF PREFERRED EMBODIMENTS

In the following description, similar features in the drawings have been given similar reference numerals and in order to lighten the figures, some elements are not referred to in some figures if they were already identified in a precedent figure.

The present invention concerns an automated system 10 of sorting elongated wood boards 12 for preparing rows 14 of a predetermined maximum width which advantageously allows to increase productivity and reduce labor costs generally involved in the manual sorting of the wood pieces.

Figure 2:
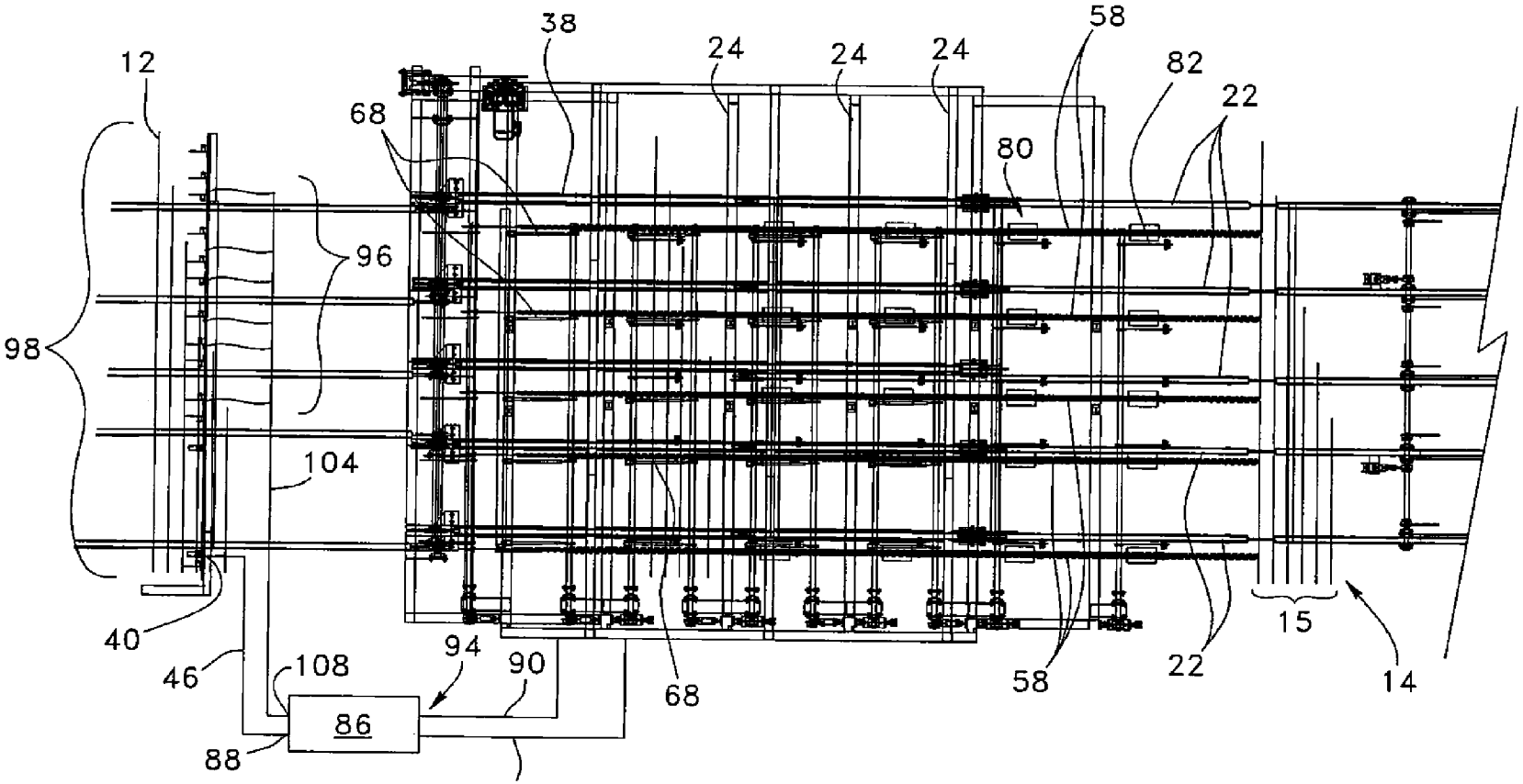
FIG. 2 is a top view of the sorting system of FIG. 1.

Referring to FIGS. 1 and 2, a system 10 for sorting elongated random width 13 wood boards 12 and for preparing board rows 14 having a row width 15 within a predetermined width range is shown. A main longitudinal surface 16, having an entry 18 and an exit 20, supports the boards 12 that are conveyed thereon. Better shown in FIG. 2, the main surface 16 s formed by several in-line longitudinal members 22 spaced so that they can support the shortest boards to be sorted and extends on a width so that the longer boards can also be steadily supported. The main conveying surface 16 is upward inclined so that its exit 20 is higher than its entry 18. Preferably, the longitudinal members 22 forming the main surface 16 are made from metal and they are attached to transverse structure members 24.

A conveyor 26 conveys the boards 12 transversally on the main surface 16. The conveyor 26 is located above the main surface 16. It has a first wheel 28 located above the entry 18 of the main longitudinal surface 16 and a second wheel 30 located above its exit 20. A closed chain 32, such as a drive chain, extends between the wheels 28, 30 and is parallel to the main surface 16. The first wheel 28 is preferably a drive wheel, driven by a motorized gear system 34 and the second wheel 30, a driven wheel. The wheels 28, 30 preferably consist of sprockets, so that the closed roller chain 32 can transmit the mechanical force in order to drive the 30 second wheel.

As shown in FIG. 1 and FIGS. 3A-3D, the closed chain 32 is provided with regularly spaced fingers 36. The fingers 36 can push the boards 12 flat over the main conveying surface 16, each finger 36 pushing one board 12 at a time. The fingers 36 are regularly spaced on the chain 32, and have a width similar to that of the roller chain 32 and a height that allows the boards 12 to be pushed on the main surface 16.

As illustrated in FIG. 2, the conveyor consists of several in-line roller-chain conveyors 38, placed directly above the longitudinal members 22 forming the main surface 16. The sorting system illustrated in FIG. 2 shows five in-line roller-chain conveyors 38, but the number of such conveyors 38 may vary according to each wood sorting application.

As shown in FIGS. 1 and 2, a width detector 40 to detect the width of each one of the boards 12 conveyed on the main surface 16 is located at the entry 18 of the main surface 16. The width detector 40 is preferably a photocell or a photodetector but it could be a limit switch, a camera or any other type of detector able to generate a width detecting signal 46 through an output 48. The width detector 40 may be placed under, on the side or above the boards conveyed as long as it can detect a first edge 42 of the boards when boards pass by the detector and then detect a second edge 44 of the boards as they continue on the main surface 16. The detector 40 sends a non-detecting signal when no boards interfere with the photocell emitter or the likes and sends a detecting signal 46 when detecting the first 42 and second edge 44 of the boards 12, the distance between the two edges 42, 44 defining the width 13 of a board 12. The signal 46 is wire-transmitted or air-transmitted to a controller 86.

Referring to FIG. 1, FIGS. 3A-3D, and FIG. 4A, accumulating compartments 50 are located one after the other under the main surface 16. Each one the accumulating compartment 50 has an entrance 52 and an exit 54. Preferably, the accumulating compartments 50 are trays having downwardly inclined surfaces 56 that extend from the entrances 52 to the exits 54. In other words, each of the entrances 52 of the accumulating compartments 50 is higher than its corresponding exit 54. This allows the boards 12 to slide down on the inclined surfaces 56 towards the exits 54 of the accumulating compartments. The downwardly inclined surface 56 may be formed by bars 58 placed directly below the longitudinal members 22 of the main surface 16.

Sliding means 60 allows board rows 14 to slide off when exiting the accumulating compartments 50. Preferably, the accumulating compartments 50 are also provided with sliding means 60 for the boards to slide down flat on the inclined surface 56. Sliding means 60 may be formed by rollers 62 located on each side of the bars 58, as better shown in FIGS. 3A to 3D. Sliding means may also be formed by a sliding surface having a low-friction layer of material, may it be metal, such as aluminum, a resistant type of plastic, etc. As illustrated in FIG. 2, the width of the accumulating compartment 50 corresponds to the width of the main surface 16.

Figure 5B:
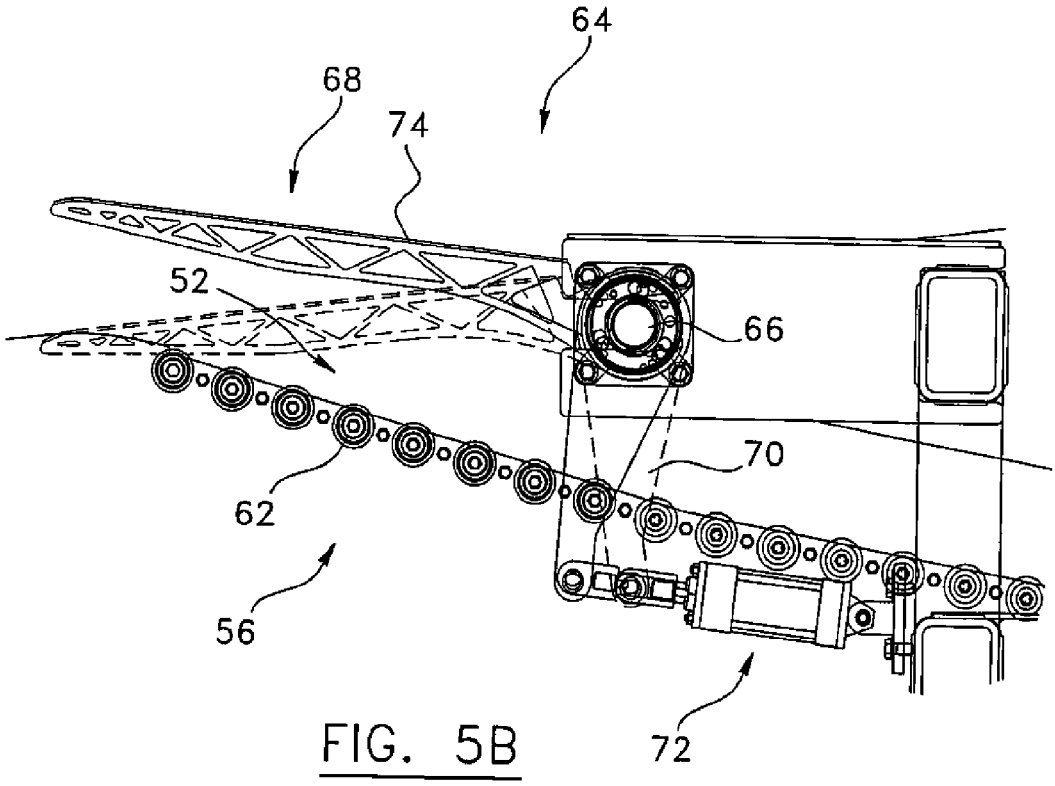
FIG. 5B is a side view of the trap of FIG. 5A, showing the gate in an opened position and in a closed position.
Figure 5A:
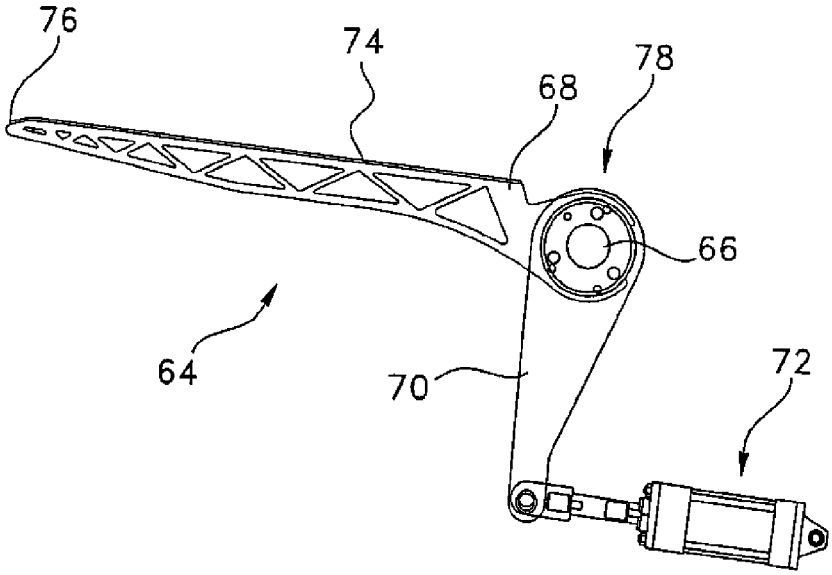
FIG. 5A is a side view of a trap shown in FIG. 1.

Referring to FIGS. 1 and 3A to 3D, controllable traps 64 are located on the main surface 16. Each trap 64 provides access to the entrance 52 of an accumulating compartment 50. Better shown in FIGS. 5A and 5B, a trap 64 is in fact made by a shaft 66, transversal to the main surface 16, and one or several trap doors 68 which are solid with the shaft 66. As shown in FIG. 2, several trap doors 68 are positioned parallel and next to the longitudinal member 22 of the main surface 16. The shaft 66 can rotate around its transversal axis. The rotation of the shaft 66 is driven by a lever arm 70 itself driven by a piston 72, such as the ones used in hydraulic or pneumatic systems. The rotation of the shaft 66 clockwise and counterclockwise allows the trap doors 68 to respectively move from a closed position to an opened position and back to the closed position. In the closed position, upper surfaces 74 of the trap doors 68 are in continuity with the main surface 16, and therefore support boards 12 conveyed thereon. When the shaft 66 rotates, the trap doors 68 open until they reach the opened position. In this position, an aperture or access is created on the main surface 16 and boards 12 conveyed on the main surface 16 can be distributed through the corresponding accumulating compartment 50 through the entrance 52 of the compartment.

A trap door 68 member can be a metallic piece having the shape of an elongated triangle. The tips 76 of the trap door members having the most acute angle are lifted when the trap door opens, and the opposite end 78 of the trap door 68 members are attached to the shaft 66. Of course, a trap door 68 may also be made for a single trap door member, extending over its accumulating compartment 50.

Referring to FIGS. 1 and 3A to 3D, controllable gates 80 are located at the exit 54 of the accumulating compartments 50. Each gate 80 can selectively block and unblock the exit 54 of its corresponding accumulating compartment 50. The boards 12 accumulating in a compartment 50 are retained in it when the gate 80 is in a blocking position, and they are released from the compartment 50 when the gate 80 is in an unblocking position.

Figure 6B:
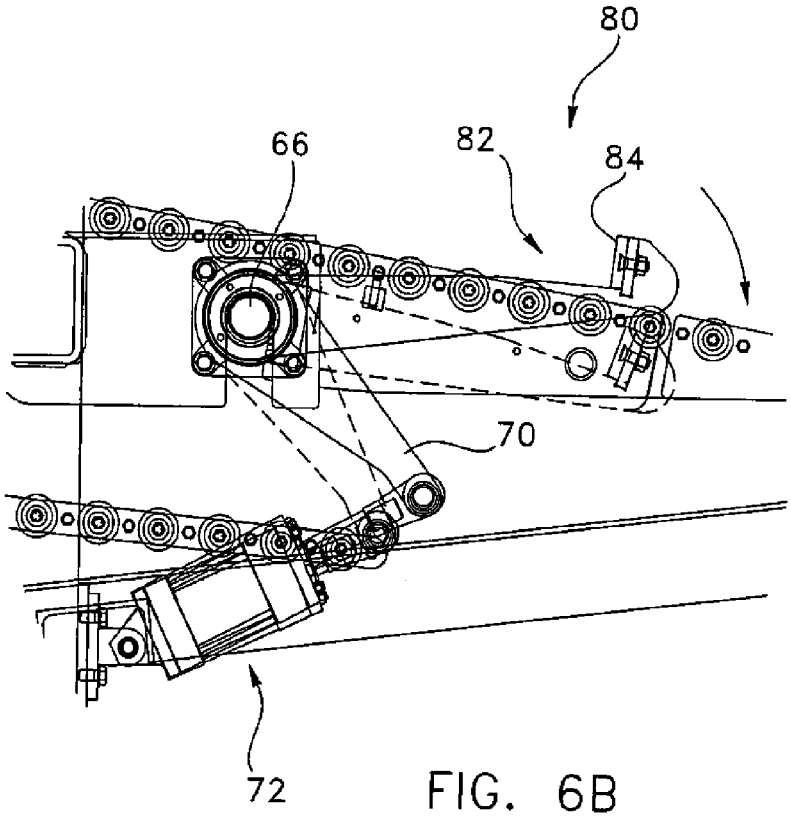
FIG. 6B is a side view of the gate of FIG. 6A, showing the gate in a blocking position and in an unblocking position.
Figure 6A:
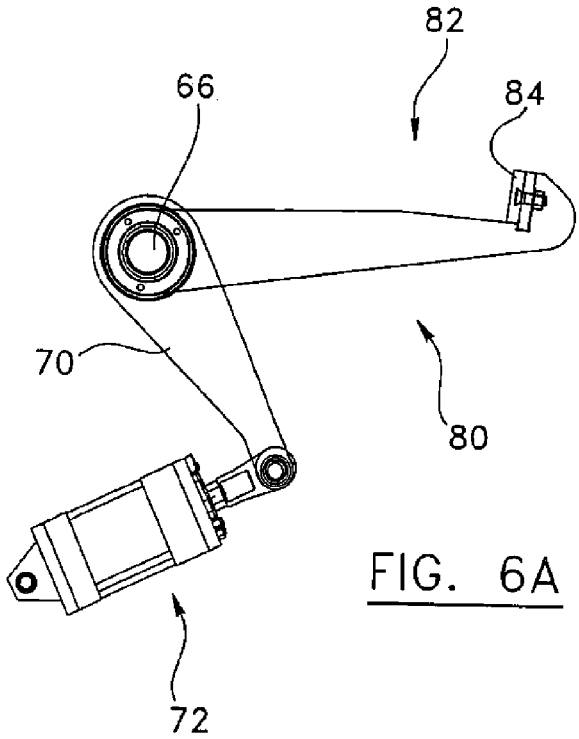
FIG. 6A is a side view of a gate shown in FIG. 1.

Better shown in FIGS. 6A and 6B, a gate 80 in fact preferably comprises a shaft 66, transversal to the main surface 16, and one or several hooks 82 which are solid with the shaft 66. As shown in FIG. 2, the hooks 82 are positioned right next to the bars 58 of the accumulating compartment 50. The shaft 66 can rotate around its transversal axis. As for the shafts 66 of the trap doors 68, the rotation of the shafts 66 of the gate 80 is driven by a lever arm 70 itself driven by a piston 72 such as the ones used in hydraulic or pneumatic systems.

The hook 82 can be a metallic piece having the shape of an "L". One end of the longer portion of the L is solid with the shaft 66 and the smaller portion is used to retain the boards into an accumulating compartment. The rotation of the shaft clockwise and counterclockwise allows the smaller portion of the L to respectively be lowered below the inclined surface 56 of the accumulating compartment and allows the boards 12 to slide off the compartment 50, and be raised above the inclined surface 56 to retain the boards within the compartment 50. Preferably, a rubber 84 is placed on the smaller portion of the L to avoid damaging the boards 12 when they are hitting one another when being distributed in the compartments 50.

As depicted in FIG. 1, a controller 86 is operatively connected to the width detector 40, to the traps 64 and to the gates 80. The controller 86 can be a programmable logic controller (PLC), as commonly used for automation of industrial processes, a personal computer (PC) or a server. It is understood that the controller 86 may also be distributed over several PLCs, PCs or servers. The controller 86 has an input in order to receive the width detecting signal 46 for each of the boards 12 sent by the width detector 40. It also has an output 94 to send control signals 90 to the controllable traps 64 in response to the width detecting signal 46. The control signals 90 are sent to selectively distribute each of the boards 12 into the accumulating compartments 50. Another output 94 also sends other control signals 92 to the controllable gates 80 of the accumulating compartments 50 to retain the boards 12 into the compartments until board rows are 14 completed and to release them when the sum of the widths of the boards 12 accumulated in a compartment 50 is within the predetermined width range.

Figure 3A:
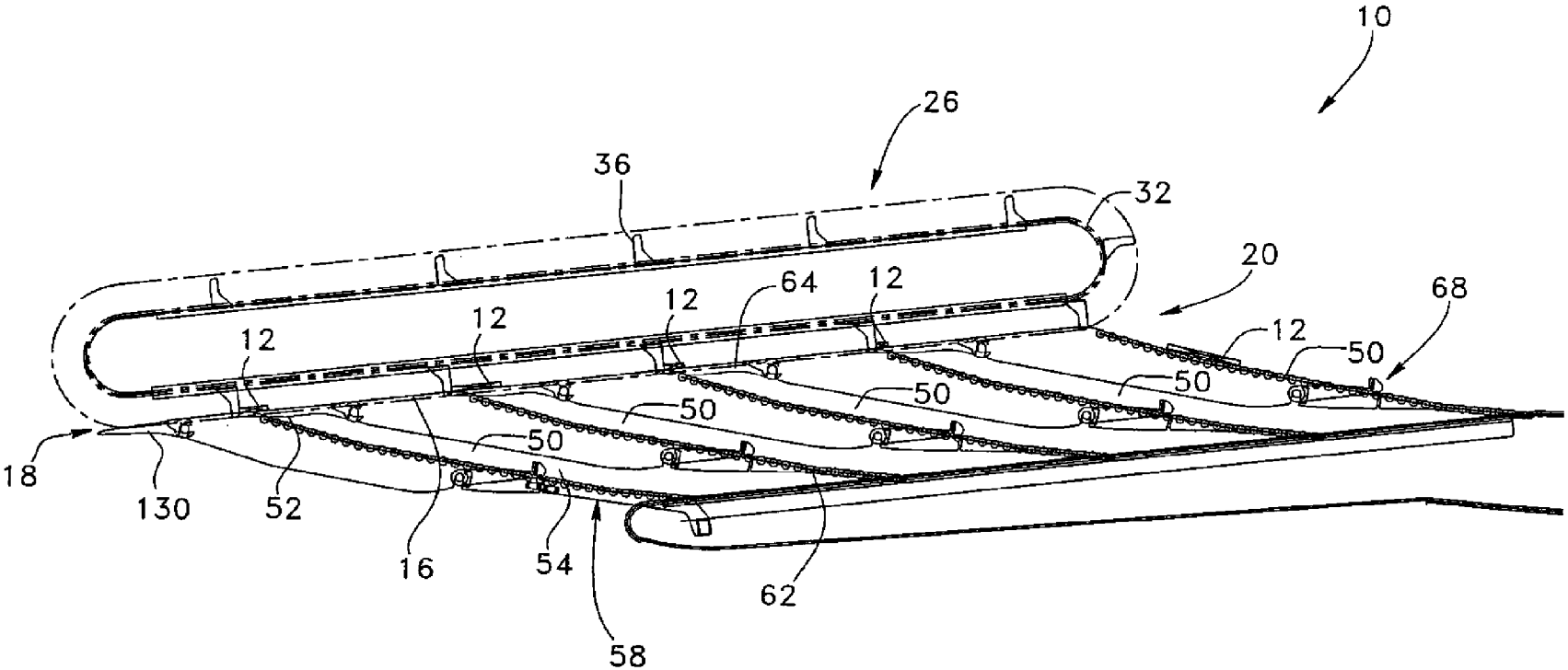
FIG. 3A is a side view of the sorting system of FIG. 1 with some elements removed for clarity purposes, showing a first step of the sorting process wherein boards are conveyed on a main surface of the system and wherein a first board is distributed into a first accumulating compartment.
Figure 3B:
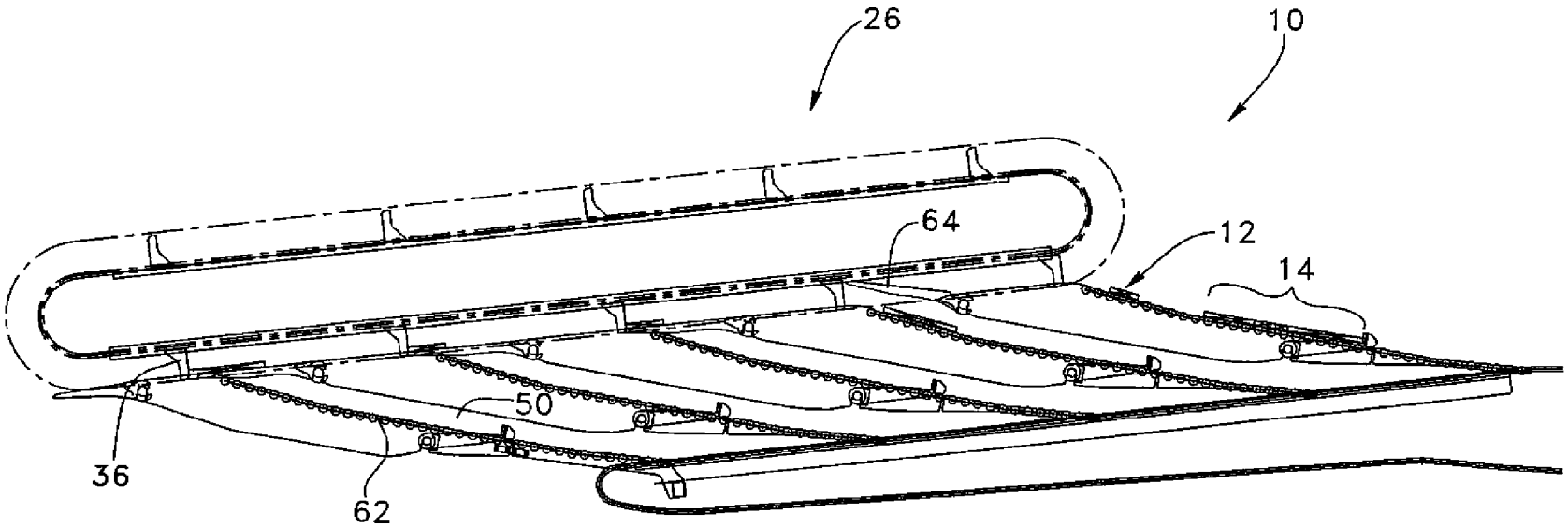
FIG. 3B is a side view of the sorting system of FIG. 3A, showing a second step of the sorting process, where the trap of a second accumulating compartment is opened in order to provide access for a board to be distributed therein.
Figure 3C:
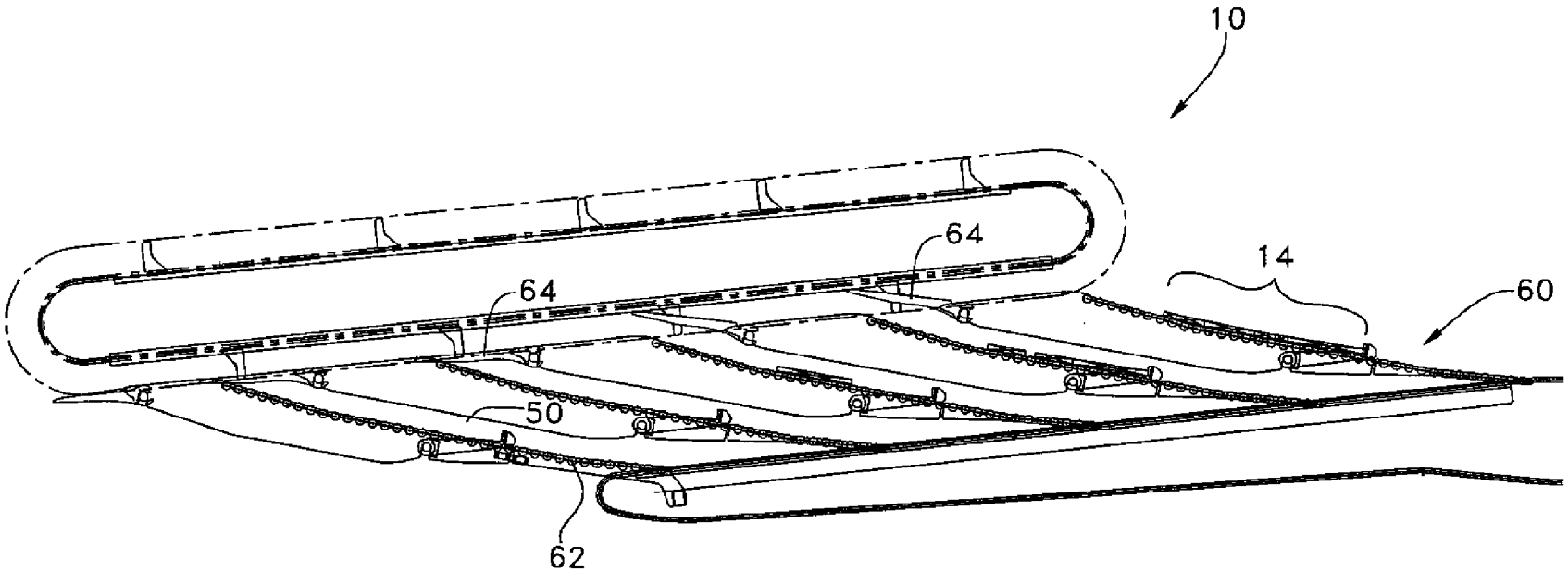
FIG. 3C is a side view of the sorting system of FIG. 3A, showing a third step of the sorting process, where the trap of a third accumulating compartment is opened in order to provide access for a board to be distributed therein and where a row of boards is formed in the first accumulating compartment.
Figure 3D:
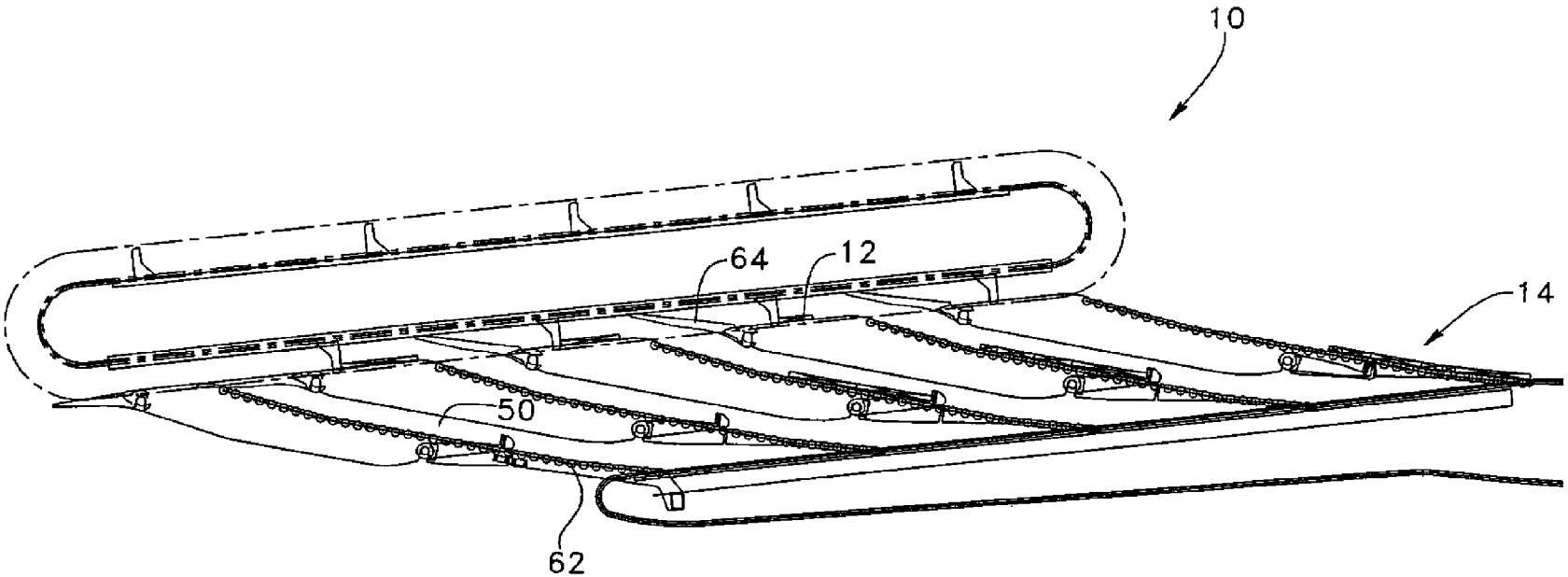
FIG. 3D is a side view of the sorting system of FIG. 3A, showing a fourth step of the sorting process, where a completed row is released by the gate of the first accumulating compartment.

Referring to FIGS. 3A to 3D, during operation of the system 10, the controller 86 distribute a board 12 in a first accumulating compartment 50 for forming a first row 14 as long as the boards 12 accumulated in the compartments 50 are not within the predetermined maximum width range, and distribute the subsequent boards in the remaining accumulating compartments for forming subsequent rows 14 until a board 12 having a width allowing the first row distributed in the first accumulating compartment to be completed. More particularly, as shown in FIG. 3A, the first board 12 is distributed in the rightmost accumulating compartment 50 seen on this figure. Then, as illustrated in FIG. 3B, the four subsequent boards 12 are also distributed in the rightmost tray. However, the next board is too large to complete the row formed in the rightmost tray. Thus, the controller 86 sends a control signal 90 to open the trap of the accumulating compartment adjacent the first accumulating compartment for distributing this board in another compartment. As shown in FIG. 3C, this process is repeated until a board having the width required for the width row to be completed or in other words to be within a predetermined width range comes along. In FIG. 3C, boards have been distributed within three different compartments. When the board of the required width for completing the row of the rightmost tray is detected, it is conveyed and then distributed therein. In FIG. 3D, the row 14 on the first accumulating compartment has been completed and is released from the compartment 50 onto sliding means 60 for further processing external to this system. At that time, the controller 86 sends another control signal 92 to the gate 80 to release the boards 12 from the accumulating compartment 50.

The sorting system 10 may advantageously be further provided with a length detector 96 in order for the system 10 to further sort the boards 12 according to their length 98. When such detector 96 is added to the system 10, it is preferably located at the entry 18 of the main surface 16. The length detector 96 is preferably made of several limit switches placed in a line transversally to the conveying direction, but it could be other types of detector able to generate a detecting signal through an output. Each limit switch is provided with an output. The boards being all pre-aligned and flush with a border at their first 100 extremity, as shown in FIG. 2, before being conveyed on the main surface, the limit switches are located so that they can detect the second extremity 102 of the boards when boards 12 pass by them 96. The distance between the aligned known position of the first extremities 100 of boards and the second extremities 102 positions defines the length 98 of a board 12. From the output of one of the limit switches, a length detecting signal 104 for each of the boards 12 is sent to the controller 86. The controller 86 has an input for receiving the length detecting signals from the length detector for all boards. It can calculate the length 98 of each board since the position of one of the board's extremity is known, and since the position of the activated limit switch is also known. The controller 86 then sends control signals 90 to the controllable traps in response to the length detecting signal 104 to selectively distribute the boards 12 into the accumulating compartments 50.

It is therefore possible for the controller 86 to distribute the boards 12 according to their length 98 so that a board 12 may be formed by two wood pieces having an equal width, the boards being abutable end to end to one another. For example, a board 12 measuring 16 feet in length may be formed by two wood pieces of equal width, each one measuring 8 feet in length. The wood pieces may be abutted for forming a board prior their entry in the sorting system 10, or by an operator when exiting the accumulating compartments 50.

The sorting system 10 may also advantageously be further provided with thickness detector 110 or grade 112 detectors, in order for the system to further sort the boards 12 according to their thickness 114 or grade. Thickness detectors 110 such as a photocell detectors or similar types of detectors can be used. When a thickness detector 110 is used in the system, it is preferably placed prior the entry 18 of the main surface 16 and is able to detect the ends of each board in between which the thickness is to be measured. It sends through an output 115 a thickness detecting signal 116 to the controller 86. The controller receives the signal 116 on a thickness detecting signal input 117 and sends control signals 90 to the controllable traps 64 in response to the thickness detecting signal 116, to selectively distribute the boards 12 into the accumulating compartments 50. A grade detector 112 may also be used to detect the grade category of the boards 12. A camera or other type of visual inspection instrument can be used as a grade detector 112. The grade detector 112 sends a grade detecting signal 118 from an output 111 to a grade detecting signal 113 of the controller 86, and the controller receives it on an input and sends control signals 90 to the controllable traps 64 to selectively distribute the boards 12 into the accumulating compartments according to the grade detecting signal. The grade detector 112 is preferably be located prior the entry 18 of the main surface 16 and its overall field of view is large enough to be able to inspect the upper or lower surface of each wood board.

Different types of configurations can be used for detecting the grade of the boards. For example, a camera could be use to determine each board grade automatically. A camera could also be used to detect a mark previously made by an operator on each board indicating its grade. As a further example, an operator could visually determine the grade of each board and enter the grade of each board using an interface operatively linked to the grade detector.

Figures 4A, 4B, 4C:
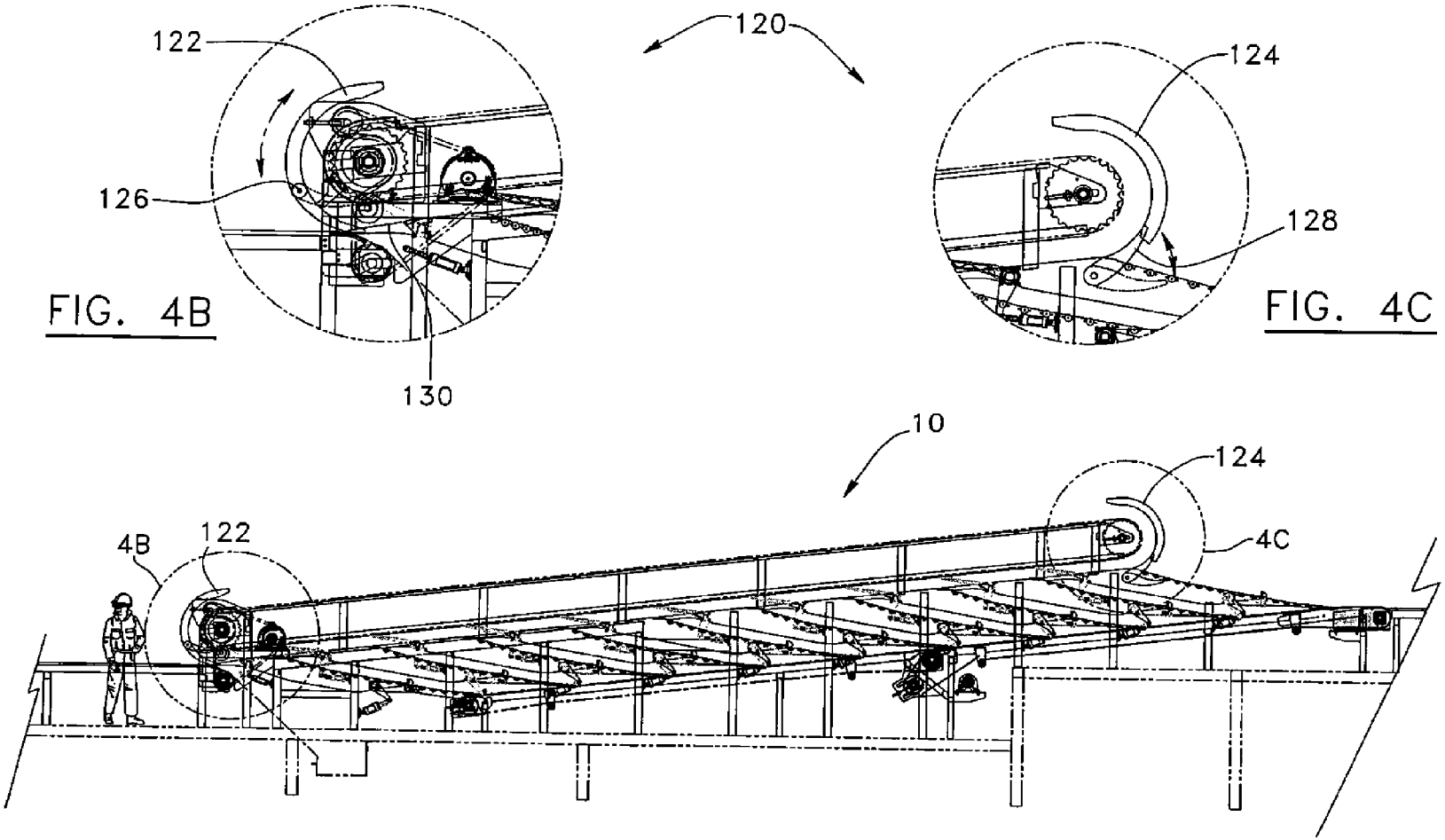
FIG. 4A is a side view of the sorting system according to another preferred embodiment of the present invention.
FIG. 4B is a partial enlarged view of FIG. 4A, showing a first semi-circular ramp allowing undistributed boards to recirculated to the entry of the main surface of the sorting system.
FIG. 4C is a partial enlarged view of FIG. 4A, showing a second semi-circular ramp allowing undistributed boards to be collected at the exit on the main surface of the sorting system.

As shown in FIGS. 4A to 4C, the system 10 may advantageously be further provided with a re-circulating system 120 that allows undistributed boards to be re-circulated back to the entry 18 of the main surface 16. An undistributed board is a board for which the width (wb) is such that when added to the width of the row of boards (Wr) accumulated in any accumulating compartment, the resulting sum is greater than the predetermined width range. This situation is more likely to occur in applications where the number of accumulating compartment is restricted. The re-circulating system 120 preferably consists of a first semi-circular ramp 122 located above the entry 18 of the main surface 16, concentric with the first wheel 28 of the conveyor 26. A second semi-circular ramp 124 is also located at the exit 20 of the main surface 16, the second ramp 124 being concentric with the second wheel 30 of the conveyor 26. The ramps 122,124 preferably extend over the width of the main surface 16. The ramps can be secured to the structure supporting the main surface or to the structure supporting the conveyor. Of course, in this configuration, the controller 86 ensure that a finger from the conveyor is left empty to be able of receive a board being re-circulated to the entry of the main longitudinal surface 16.

The first ramp 122 is provided with a controllable mechanism 126 allowing the ramp to rotate around the axis of the first wheel 28 of the conveyor 26. The ramp 122 is maintained in an upward position for allowing the boards entering the main surface to be conveyed on it, and it can be lowered when a re-circulating board needs to be dropped at the entry of the main surface.

The second ramp 124 has a fixed position. As better shown in FIG. 4C, a controllable semi-circular trap 68 may be used along with the second ramp. This semi-circular trap 68 has trap doors 128 having a semi-circular shape distinct from the elongated trap doors shaped described above. It is movable between a closed position allowing undistributed boards to be circulated in the second ramp 124 and then back to the entry 18 of the main surface 16 and an opened position providing access to the last accumulating compartment 50 of the main surface 16.

The following describes more specifically the method according to which boards 12 are distributed. When the system 10 is in operation, boards pass by the width detector 40 and the detector detects the edges 42, 44 of the boards. The edges detected are the ones in between which the width 13 of each board 12 needs to be measured. For each board, a detecting signal 46 is sent to the controller 86, which calculates the width of the board (wb). A detecting signal 46 contains the information relative to the number of cycles during which the detector 40 was detecting a board. The duration of a cycle being known, and the number of inches or centimeters corresponding to a cycle being also being known, the width of the board can be calculated: the number of cycle is multiplied by the number of inches or centimeters corresponding to a cycle. The controller 86 keeps tracks on the width 13 of each individual board 12.

The controller 86 also keeps track of the sum of the widths of the boards accumulated in each one of the accumulating compartments 50 or in other words, the row width (Wr) of boards from all accumulating compartments (Wr1, Wr2, . . . , Wrn), where n is the number of accumulating compartments.

If the sum of any of (Wr1, Wr2, . . . , Wrn) and wb is greater than the predetermined width range Wmax, the controller can either:

stop the system 10 in order to allow an operator to remove the board having the width wb, since this board cannot be distributed into an accumulating compartment;

send a control signal 90 to a chute trap 130 placed prior the sorting system so that the board can be dropped in a rejection chute; or send a control signal 92 to the re-circulating gate 80 which will force the board to use the semi-circular ramp 122 and to be re-circulated back to the entry 18 on the main conveyor 16.

If the sum of one of (Wr1, Wr2, . . . , Wrn) and wb is within the predetermined width range Wmax, the controller 86 will then send control signals 90 to the corresponding controllable traps 64 to move it from the close to the open position so that the board 12 will be distributed into its accumulating compartment 50. The controller 86 will also send another control signal 92 to the controllable gate 80 of the accumulating compartment 50 to move the gate from a blocking position to an unblocking position. The completed row 14 will thereby be released from the accumulating compartment onto sliding means 60.

Should there be more than one of (Wr1, Wr2, . . . , Wrn) for which its addition with wb resulted in a sum within the predetermined range, the board may be distributed in the closest corresponding accumulating compartment for the entrance of the main conveyor or to the one for which the sum is the closest from a predetermined width value.

If the sum of any one of (Wr1, Wr2, . . . , Wrn) and wb is below the predetermined width range Wmax, the controller 86 sends a control signal to a corresponding trap 64 to move the trap from the close to the open position for the board to be distributed into its accumulating compartment 50. No control signal is sent for opening the gate since the boards accumulating in the accumulating compartment do not yet form a completed row. When there is more than one (Wr1, Wr2, . . . , Wrn) for which the sum resulting from its addition with wb is below the predetermined width range Wmax, the boards may be distributed to the farthest compartment 50 from the entry 18 or from the closest.

When the system 10 is further provided with a length detector 96, the controller uses the length detecting signals 104 received on its input to calculate the length 98 of each board. It uses the length information to distribute the boards 12 to that the longest boards are distributed in the accumulating compartment 50 in order to be placed on each sides of the row 14 so as to form a row consisting of long boards. The longest boards have to be distributed in the accumulating compartment 50 so as to be the first or the last boards of the row retained within an accumulating compartment. In other words, a board having a length 98 which is within a predetermined length range is distributed in an accumulating compartment so as to be the first one or the last one therein, or so as to be part of a row consisting of long boards exclusively.

Although preferred embodiments of the present invention have been described in detail hereinabove and illustrated in the accompanying drawings, it is to be understood that the invention is not limited to these precise embodiments and that various changes and modifications may be effected therein without departing from the scope and spirit of the present invention.

For example, in another preferred embodiment not illustrated, the main surface consist of a continuous plane surface where the controllable traps are single or dual-leaf doors. The conveyor could also be placed on one of the side of the main surface, rather than above it. In addition, accumulating compartments could be formed by several vertical walls, parallel to one another, where an accumulating compartment is defined by two consecutive walls. In that case, the boards for forming board rows are retained or released from such compartments by controllable gates having the form of single or double-leaf swing doors. Such doors are respectively opening on sliding means having the form of inverted funnels where boards exit therefrom in flat board rows. As proposed in the above description, the sliding means may also consist of a downwardly inclined low-friction flat surface made of steel, aluminum or resistant plastic.

Width, length and thickness detecting sensors may be consisting of digital or analogous limit switches, photocell sensors or cameras. As described above, they may be located prior the entry of the main surface but could be also be placed anywhere between the entry and the exit of the main surface, for embodiments where a re-circulating system is used. The grade detector can be consisting of any type of visual inspection system, including black and white or color cameras used with or without a frame grabber. The grade detector can also be a camera detecting a grade mark on each board. It can also be an interface through which an operator would enter manually the grade of each board entering the main surface. Finally, the conversion of the sensor signals into measurements can be made by a portion of the controller operatively connected to but decentralized from the main controller.

What is claimed is:

1. A system for sorting elongated random width wood boards and preparing board rows having a row width within a predetermined width range, each one of the boards defining a board longitudinal axis, said system comprising:

a main longitudinal surface for supporting the boards, said main longitudinal surface having an entry and an exit, the main longitudinal surface having a longitudinal direction;

a conveyor for conveying the boards transversally to and on the main longitudinal surface from the entry to the exit, the board longitudinal axis of each one of the boards being conveyed at substantially a 90° with respect to the longitudinal direction of the main longitudinal surface;

a width detector to detect each of the boards that is conveyed on the main longitudinal surface and generate a width detecting signal for each of said boards;

accumulating compartments located one after the other under the main longitudinal surface, each having an entrance and an exit;

controllable traps located on the main surface, associated respectively with the accumulating compartments, each of the traps being movable between an opened position providing access to the entrance of the corresponding accumulating compartment and a closed position allowing the boards to be supported, each of the controllable traps having a length which is perpendicular and at substantially a 90° with respect to the longitudinal direction of the main longitudinal surface;

controllable gates for selectively blocking and unblocking the exits of the accumulating compartments, thereby boards accumulated in any of the accumulating compartments are selectively retained therein and released therefrom; and a controller operatively connected to the width detector, the traps and the gates, the controller having an input for receiving the width detecting signal for each of the boards from the width detector and having outputs for sending control signals to the controllable traps in response to the width detecting signal to selectively distribute each of the boards into the accumulating compartments, and for sending other control signals to the controllable gates of the accumulating compartments to release the boards accumulated therein when a sum of the widths of the boards accumulated is within the predetermined width range.

2. The system according to claim 1, wherein the main longitudinal surface is upwardly inclined, the exit of the main longitudinal surface being higher than the entry of the main longitudinal surface.

3. The system according to claim 1, wherein the conveyor comprises a first wheel located above the entry of the main longitudinal surface, a second wheel located above the exit thereof, and a closed chain extending between the first and second wheels, said chain being provided with regularly spaced fingers, the fingers being for pushing respectively said boards over the main longitudinal surface.

4. The system according to claim 3, further comprising a first semi-circular ramp located at the entry of the main longitudinal surface, said first ramp being concentric with the first wheel of the conveyor and a second semi-circular ramp located at the exit of the main longitudinal surface, said second ramp being concentric with the second wheel of the conveyor, for re-circulating undistributed boards exiting the main longitudinal surface back to the entry of said main longitudinal surface.

5. The system according to claim 1, further comprising a length detector to detect each board that is conveyed on the main longitudinal surface and generate a length detecting signal for each of said boards, wherein the controller further comprises an input for receiving the length detecting signal for each of the boards from the length detector, the controller sending control signals to the controllable traps in response to the length detecting signal to selectively distribute each of the boards into the accumulating compartments.

6. The system according to claim 5, wherein some of the boards are formed by two wood pieces abutable end to end and having equal width.

7. The system according to claim 1, further comprising a thickness detector to detect each board that is conveyed on the main longitudinal surface and generate a thickness detecting signal for each of said boards, wherein the controller further comprises an input for receiving the thickness detecting signal for each of the boards from the thickness detector, the controller sending control signals to the controllable traps in response to the thickness detecting signal to selectively distribute each of the boards into the accumulating compartments.

8. The system according to claim 1, further comprising a sliding means for sliding off boards from the accumulating compartments in board rows when released by the gates.

9. The system according to claim 8, wherein the sliding means comprises each of the accumulating compartments comprising a downwardly inclined surface extending from its entrance to its exit, each of the entrances of said accumulating compartments being higher than its corresponding exit, thereby allowing the boards to slide flat down on the inclined surfaces towards the exits of the accumulating compartments.

10. The system according to claim 9, wherein the inclined surface and the sliding means are provided with a plurality of rollers.

11. The system according to claim 1, wherein each motorized controllable trap comprises:

a piston-driven rotatable shaft transversal to the main longitudinal surface; and a trap door solid with the shaft for closing the entrance of the corresponding accumulating compartment, said trap door having an upper surface being in continuity with the main longitudinal surface when the corresponding trap is in the closed position.

12. The system according to claim 11, wherein each controllable gate comprises:

a piston-driven rotatable shaft transversal to the corresponding accumulating compartment; and a L-shaped hook solid with the shaft for blocking the exit of the corresponding accumulating compartment when the corresponding gate is in the closed position.

13. The system according to claim 1, further comprising a grade detector to detect each board that is conveyed on the main longitudinal surface and generate a grade detecting signal for each of said boards, wherein the controller further comprises an input for receiving the grade detecting signal for each of the boards from the grade detector, the controller sending control signals to the controllable traps in response to the grade detecting signal to selectively distribute each of the boards into the accumulating compartments.

14. The system according to claim 1, wherein the controllable traps have a pivot axis, the pivot axis having a direction which is perpendicular to the longitudinal direction of the main longitudinal surface.

* * * * *